US010329046B2

(12) United States Patent
Smith

(10) Patent No.: US 10,329,046 B2
(45) Date of Patent: Jun. 25, 2019

(54) TIE-LOCK SHIPPER

(71) Applicant: INTERNATIONAL PAPER COMPANY, Memphis, TN (US)

(72) Inventor: Jeffrey Smith, Medford, NJ (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 172 days.

(21) Appl. No.: 15/420,623

(22) Filed: Jan. 31, 2017

(65) Prior Publication Data

US 2018/0215498 A1 Aug. 2, 2018

(51) Int. Cl.

| | |
|---|---|
| ***B65D 5/36*** | (2006.01) |
| ***B65D 5/02*** | (2006.01) |
| ***B65D 5/42*** | (2006.01) |
| ***B65D 5/66*** | (2006.01) |
| ***B31B 50/60*** | (2017.01) |
| *B31B 50/26* | (2017.01) |
| *B31B 100/00* | (2017.01) |
| *B31B 120/30* | (2017.01) |
| *B31B 50/73* | (2017.01) |

(52) U.S. Cl.

CPC ..... *B65D 5/3628* (2013.01); *B31B 50/60* (2017.08); *B65D 5/02* (2013.01); *B31B 50/26* (2017.08); *B31B 50/732* (2017.08); *B31B 2100/00* (2017.08); *B31B 2120/30* (2017.08)

(58) Field of Classification Search

CPC .... B65D 5/3628; B65D 5/02; B65D 5/46144; B65D 5/46112; B65D 5/2057; B65D 5/3678; B31B 1/26; B31B 1/60

USPC ..... 229/117.01, 117.15, 186, 157, 117.05, 229/178, 148

See application file for complete search history.

(56) References Cited

U.S. PATENT DOCUMENTS

| | | | | |
|---|---|---|---|---|
| 2,962,203 | A | 11/1960 | Fallert | |
| 3,062,426 | A | 11/1962 | Mason | |
| 3,100,072 | A | 8/1963 | Mason | |
| 4,091,984 | A | 5/1978 | McFarland | |
| 4,214,695 | A | 7/1980 | Cooper | |
| 5,520,080 | A | 5/1996 | Sandford | |
| 5,549,243 | A | 8/1996 | Dorier et al. | |
| 5,851,630 | A | 12/1998 | Davis, II | |
| 6,155,479 | A * | 12/2000 | Wellner | B65D 5/2047 229/117.08 |
| 6,164,526 | A * | 12/2000 | Dalvey | B65D 5/0005 206/427 |
| 6,290,123 | B1 | 9/2001 | Pei | |

(Continued)

*Primary Examiner* — Christopher R Demeree
(74) *Attorney, Agent, or Firm* — Michael D. Folkerts; Thomas W. Ryan

(57) ABSTRACT

A blank for making a one-piece container. The blank includes a central first section, a pair of second sections connected to the first section along a respective first longitudinal score line, and a pair of third sections, each third section connected to a second section along a respective second longitudinal score line. The second sections define side walls and end walls of the container, and the third sections define bottom flaps of the container. The first section includes a pair of top lateral flaps located on either side of a longitudinal slit that divides the blank in half. A pair of top end flaps span across opposing longitudinal ends of the top lateral flaps. Each top end flap comprises a triangular section defining a bow-tie lock connecting two halves of the blank on either side of the longitudinal slit.

17 Claims, 4 Drawing Sheets

(56) References Cited

U.S. PATENT DOCUMENTS

| | | | | |
|---|---|---|---|---|
| 6,527,445 | B2 | 3/2003 | LaFleur et al. | |
| 6,736,309 | B1 * | 5/2004 | Westerman | B65D 5/2057 229/117.05 |
| 7,789,292 | B2 | 9/2010 | West | |
| 9,499,294 | B1 * | 11/2016 | Costanzo, Jr. | B65D 5/241 |
| 2004/0031842 | A1 * | 2/2004 | Westerman | B65D 5/2057 229/117.06 |
| 2016/0068297 | A1 * | 3/2016 | Arki | B65D 5/3642 229/117.15 |

* cited by examiner

TIE-LOCK SHIPPER

FIELD OF THE INVENTION

The present invention relates to improvements in shipping containers and, more particularly, to a shipping container that combines aspects of a regular slotted container and a "bow-tie" structure.

BACKGROUND OF THE INVENTION

A regular slotted container (RSC) is a common construction for forming corrugated cardboard containers. This type of container is typically formed from a blank that includes side and end wall panels connected in series at vertical edges along fold lines, and top and bottom end flaps may extend from opposing upper and lower edges of the side and end panels. The blank is folded about the vertical edges to position an end of the blank defining an edge of a side panel in association with an opposing end of the blank defining an edge of an end panel adjacent to each other at a joint that is typically adhered together by a manufacturer to form a rectangular tube. The blank formed with the manufacturer's joint can be collapsed and provided to an end user where the blank can be reconfigured to a rectangular tube and the flaps folded perpendicular to the side and end panels to complete the container.

SUMMARY OF THE INVENTION

In accordance with an aspect of the invention, a blank is provided for making a one-piece container. The blank comprises a central first section, a pair of second sections connected to the first section along a respective first longitudinal score line, the second sections defining side walls and end walls of the container, and a pair of third sections, each third section connected to a second section along a respective second longitudinal score line, the third sections defining bottom flaps of the container. The first section includes a pair of top lateral flaps located on either side of a longitudinal slit that divides the blank in half, and a pair of top end flaps spanning across opposing longitudinal ends of the top lateral flaps. Each top end flap comprises a triangular section defining a bow-tie lock connecting two halves of the blank on either side of the longitudinal slit.

The longitudinal slit may extend into the top end flaps, and may include first lateral slits bisected by the longitudinal slit and defining a separation between the top lateral flaps and each top end flap.

Each bow-tie lock may be defined by a pair of perforated score lines that diverge from an area at an outer longitudinal side of the corresponding top end flap.

The perforated score lines of each bow-tie lock may have distal ends connected by a second lateral slit that is bisected by an end of the longitudinal slit.

Each top end flap may divided into two half sections along a first portion by the longitudinal slit and along a remaining portion by a central score line extending longitudinally across the bow-tie lock, and the two half sections of each top end flap may be pivotable relative to each other about the bow-tie lock during formation of the container to position the outer longitudinal sides of the two half sections adjacent to each other.

Each of the second sections may include a side wall and first and second end wall panels connected to opposing longitudinal ends of the side wall along respective lateral score lines.

First lateral slits may span between the first longitudinal score lines, and the lateral score lines may be collinear with respective ones of the first lateral slits.

A lateral edge of each of the end wall panels may be connected to a lateral edge of one of the top end flaps at a respective first longitudinal score line.

Each of the third sections may include a bottom lateral flap connected to one of the side walls at a respective second longitudinal score line, and one of the third sections may further include first and second bottom end flaps connected to adjacent first and second end wall panels along one of the second longitudinal score lines.

In accordance with another aspect of the invention, a container is provided including a pair of opposing side walls and a pair of opposing end walls, a top lateral flap hingedly connected to each side wall, a top end flap hingedly connected to each end wall, and bottom flaps hingedly connected to the side walls and the end walls. The container further comprises each top end flap comprising two half sections separated by a flap slit. Each top end flap further comprises a bow-tie lock integrally formed as part of the two half sections of the top end flap, the bow-tie lock spanning the flap slit and connecting the two half sections.

Each bow-tie lock may define a triangular section having a base extending laterally across the flap slit and sides extending diagonally from the base to a point at the flap slit.

Each end wall may comprise an inner end wall panel hingedly connected to one of the side walls and an outer end wall panel hingedly connected to the other of the side walls and overlapping an adjacent inner end wall panel.

One of the two half sections of each top end flap may be hingedly connected to one of the inner end wall panels and the other of the two half sections may be hingedly connected to one of the outer end wall panels.

In accordance with a further aspect of the invention, a method of forming a container from a blank is provided. The blank for performing the method comprises a central first section; a pair of second sections connected to the first section along a respective first longitudinal score line, the second sections defining side walls and end walls of the container and comprising first and second end wall panels connected at lateral score lines to longitudinal ends of each of the side walls; a pair of third sections, each third section connected to a second section along a respective second longitudinal score line, the third sections defining bottom flaps of the container; the first section including a pair of top lateral flaps located on either side of a longitudinal slit that divides the blank in half, and a pair of top end flaps spanning across opposing longitudinal ends of the top lateral flaps; each top end flap including a triangular section defining a bow-tie lock connecting two halves of the blank on either side of the longitudinal slit. The method comprises folding the blank in half at the longitudinal slit line to position a first half of the blank adjacent to a second half of the blank; and folding the first and second end wall panels about the lateral score lines to orient the end wall panels perpendicular to the side walls, wherein the end walls of the container are each defined by a pair of the end wall panels positioned in overlapping relationship adjacent to each other.

Each top end flap may comprise two half sections and a bow-tie lock integrally formed as part of the two half sections.

The two half sections of each top end flap may be pivotable relative to each other about the bow-tie lock during folding of the blank so as to position outer longitudinal sides of the two half sections adjacent to each other and define a flap slit separating the two half sections.

The end wall panels defining each end wall may comprise adjacent inner and outer end wall panels, and one of the two half sections of each top end flap may be hingedly connected to one of the inner end wall panels and the other of the two half sections may be hingedly connected to one of the outer end wall panels.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a container construction that combines aspects of a regular slotted container (RSC) with a bow-tie structure that enables different sides of a blank for the container to be held together. In accordance with an aspect described herein, a one piece container is provided formed of a flat die cut blank that is folded to define a rectangular tube shape having top and bottom flaps that fold to replicate an RSC style container. The container is further characterized by a pair of bow-tie locks defining a connection between two halves of the blank that forms the RSC style container.

Figure 1:
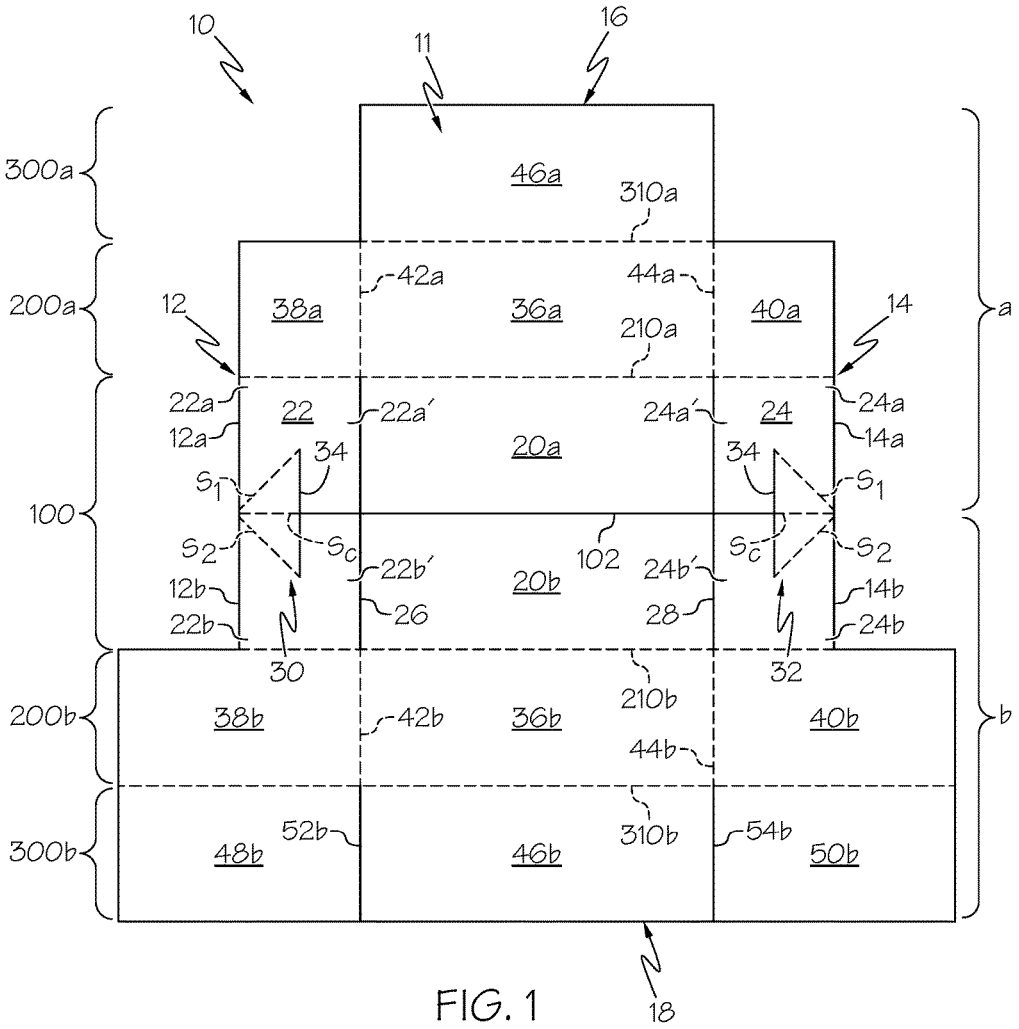
FIG. 1 is a plan view of blank for forming a container.
Figure 2:
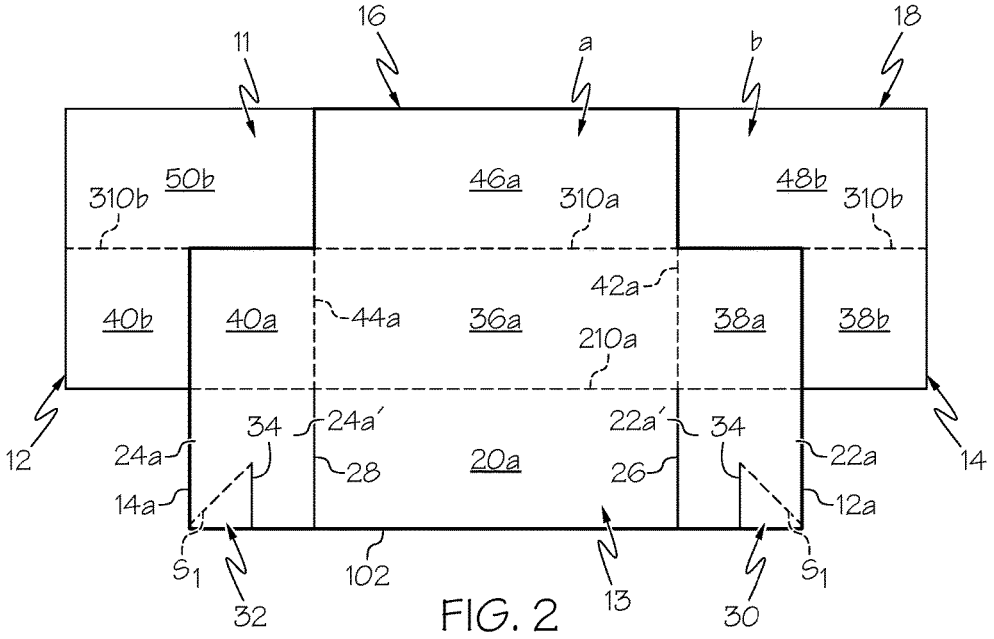
FIG. 2 is a plan view of the blank of FIG. 1 folded in half for forming the container.

Referring to FIG. 1, a die cut blank 10 is shown for illustrating one or more aspects of the invention. In a use of the blank to form a one piece container, the blank 10 may be formed of a corrugated cardboard material and may be die cut to the shape shown herein, although other materials and variations of the illustrated shape may be provided within the scope of the container described and claimed herein. The blank 10 illustrated in FIG. 1 is a planar piece of material in which an inner side 11 is shown facing out of the page and an outer side 13, see FIG. 2, is facing in an opposite direction from the inner side 11.

As seen in FIG. 1, the blank 10 extends in a longitudinal direction between first and second longitudinal edges, generally designated 12 and 14, respectively, and further extends in a lateral direction between first and second lateral edges, generally designated 16 and 18, respectively. The blank 10 comprises a central first section 100, a pair of second sections 200*a*, 200*b* connected to the first section 100 along a respective first longitudinal score line 210*a* and 210*b* extending from the first longitudinal side 12 to the second longitudinal side 14. The blank further comprises a pair of third sections 300*a*, 300*b*. Each third section 300*a*, 300*b* is connected to a corresponding second section 200*a*, 200*b* along a respective second longitudinal score line 310*a* and 310*b* extending from the first longitudinal side 12 to the second longitudinal side 14.

A longitudinal slit 102, defining a longitudinal slit line, is formed in the blank 10 halfway between the lateral edges 16, 18 and divides the blank into two halves, generally designated first half "a" and second half "b". The first section 100 includes a pair of top lateral flaps 20*a*, 20*b* located on either side of the longitudinal slit 102. The first section 100 further includes a pair of top end flaps 22, 24 spanning across opposing longitudinal ends of the top lateral flaps 20*a*, 20*b*, wherein a pair of first lateral slits 26, 28 define a separation between the top lateral flaps 20*a*, 20*b* and the top end flaps 22, 24. Each top end flap 22, 24 comprises a triangular section defining a respective bow-tie lock 30, 32 adjacent the respective longitudinal edges 12, 14. The longitudinal slit 102 bisects the pair of first lateral slits 26, 28 and extends into the top end flaps 22, 24 up to a longitudinal location adjacent to the bow-tie locks 30, 32. The bow-tie locks 30, 32 form bridge pieces connecting the two halves "a" and "b" of the blank 10 on either side of the longitudinal slit 102.

Each bow-tie lock 30, 32 is defined by a pair of perforated score lines S1, S2 that diverge from an area, such as near or at a point, at the outer longitudinal sides 12, 14 of the corresponding top end flap 22, 24. The perforated score lines S1, S2 of each bow-tie lock 30, 32 have distal ends connected by a second lateral slit 34 that is bisected by an end of the longitudinal slit 102. Hence, the perforated score lines S1, S2 and lateral slit 34 of each bow-tie lock 30, 32 define a triangular bridge piece spanning between the two blank halves "a" and "b". Each top end flap 22, 24 is divided into two half sections 22*a*, 22*b* and 24*a*, 24*b*. The two half sections 22*a*, 22*b* and 24*a*, 24*b* are defined by a segment of the longitudinal slit 102 extending along a first portion of the corresponding top end flap 22, 24 and are further defined along a remaining portion of the top end flaps 22, 24 by a central score line Sc extending longitudinally across the bow-tie lock 30, 32. During formation of a container, the two half sections 22*a*, 22*b* and 24*a*, 24*b* of each top end flap 22, 24 are pivotable relative to each other about the score line Sc of the bow-tie lock 30, 32 to position outer longitudinal sides of the two half sections 22*a*, 22*b* and 24*a*, 24*b* adjacent to each other. Specifically, as is discussed in greater detail below, during folding of the blank 10 to form a container, the outer longitudinal sides 12*a*, 12*b* of the two half sections 22*a*, 22*b* are repositioned adjacent to each other and the outer longitudinal sides 14*a*, 14*b* of the two half sections 24*a*, 24*b* are repositioned adjacent to each other, see FIG. 5.

The second sections 200*a*, 200*b* define first and second side walls 36*a*, 36*b* that are coextensive in the longitudinal direction with respective top lateral flaps 20*a*, 20*b*. The second section 200*a* further includes first and second inner end wall panels 38*a*, 40*a* that are connected to opposing longitudinal ends of the first side wall 36*a* along respective lateral score lines 42*a*, 44*b*. The second section 200*b* further includes first and second outer end wall panels 38*b*, 40*b* that are connected to opposing longitudinal ends of the second side wall 36*b* along respective lateral score lines 42*b*, 44*b*.

A lateral edge of each of the inner end wall panels 38*a*, 40*a* is connected to and is coextensive in the longitudinal direction with a lateral edge of a respective top end flap 22, 24 at the first longitudinal score line 210*a*. A lateral edge of each of the outer end wall panels 38*b*, 40*b* is connected to a lateral edge of a respective top end flap 22, 24 at the first longitudinal score line 210*b*. The outer end wall panels 38*b*, 40*b* extend in the longitudinal direction a dimension that is approximately twice the longitudinal dimension of the top end flaps 22, 24. It may be noted that the lateral score lines 42*a*, 42*b* are collinear with the first lateral slit 26, and that the lateral score lines 44*a*, 44*b* are collinear with the other first lateral slit 28. Also, it can be seen that the first lateral slits 26, 28 span between the first longitudinal score lines 210*a*, 210*b*, such that the top end flaps 22, 24 are supported to the blank 10 solely at the connections to the inner and outer end wall panels 38*a*, 40*a* and 38*b*, 40*b* along the respective first longitudinal score lines 210*a* and 210*b*.

The third sections 300*a*, 300*b* include a bottom lateral flap 46*a*, 46*b* connected to and coextensive in the longitudinal direction with the side walls 36*a*, 36*b* at a respective second longitudinal score line 310*a*, 310*b*. The third section 300*b* further includes first and second bottom end flaps 48*b*, 50*b* connected to the adjacent first and second outer end wall panels 38*b*, 40*b* along the second longitudinal score line 310*b*. The first and second bottom end flaps 48*b*, 50*b* are separated from the longitudinal ends of the bottom lateral flap 46*b* at respective lateral flap slits 52*b*, 54*b*.

Referring to FIGS. 2-5, steps illustrating a method of folding the blank 10 to form a container are shown. In FIG. 2 the blank 10 is initially folded about the longitudinal slit 102. For example, the first half "a" of the blank 10 may be pivoted about the longitudinal slit 102 to position the inner side 11 of the first half "a" facing the inner side 11 of the second half "b" of the blank 10. The folding of the blank 10 additionally includes folding of the bow-tie locks 30, 32 about the central score line SC. In the position shown in FIG. 2, the outer longitudinal side 12*a* of the half section 22*a* is positioned adjacent to and is coextensive with the outer longitudinal side 12*b* (not seen in FIG. 2) of the half section 22*b* (not seen in FIG. 2) extending in the lateral direction from the longitudinal slit 102. Similarly, the outer longitudinal side 14*a* of the half section 24*a* is positioned adjacent to and is coextensive with the outer longitudinal side 14*b* (not seen in FIG. 2) of the half section 24*b* (not seen in FIG. 2) extending in the lateral direction from the longitudinal slit 102.

Figure 3:
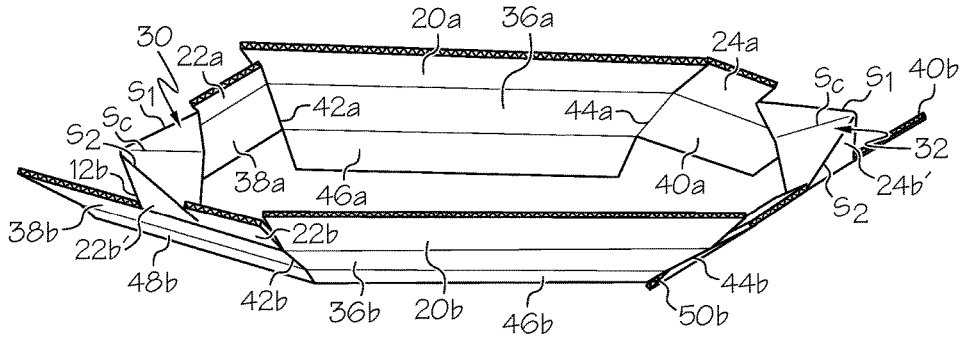
FIG. 3 is a perspective view illustrating an initial folding of end wall panels for forming the container.

Referring to FIG. 3, an initial side folding step is illustrated in which the first and second inner end wall panels 38*a*, 40*a* are pivoted inwardly about the lateral score lines 42*a*, 44*a* toward the first and second outer end wall panels 38*b*, 40*b*. Similarly, the first and second outer end wall panels 38*b*, 40*b* are pivoted about the lateral score lines 42*b*, 44*b* toward the first and second inner end wall panels 38*a*, 40*a*. It should be noted that the bow-tie locks 30, 32 provide a flexible hinge connection between the first and second blank halves "a" and "b", wherein the two half sections 22*a*, 22*b* and 24*a*, 24*b* of each top end flap 22, 24 are pivotable relative to each other about the bow-tie lock 30, 32. As seen in FIG. 3, as the inner end wall panels 38*a*, 40*a* and outer end wall panels 38*b*, 40*b* are pivoted, the bow-tie locks 30, 32 fold out from a doubled-over configuration toward a flat configuration. The bow-tie locks 30, 32 permit movement of the inner end wall panels 38*a*, 40*a* in a direction of pivoting movement that is opposite to the direction of pivoting movement of the outer end wall panels 38*b*, 40*b*. As the inner end wall panels 38*a*, 40*a* and outer end wall panels 38*b*, 40*b* pivot, the side walls 36*a*, 36*b* remain generally parallel to each other and move away from each other.

Figure 4:
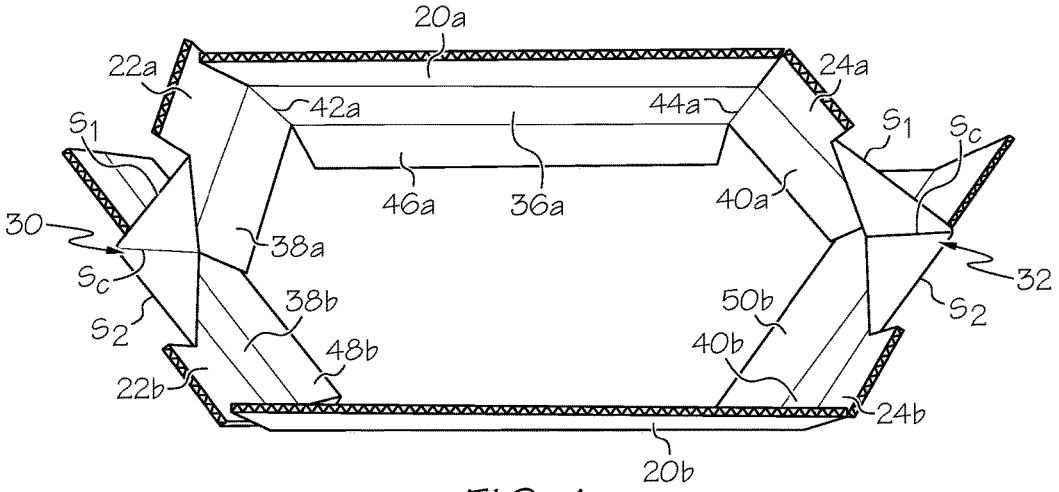
FIG. 4 is a perspective view illustrating further folding of the end wall panels in a position approaching perpendicular to side walls for the container.
Figure 5:
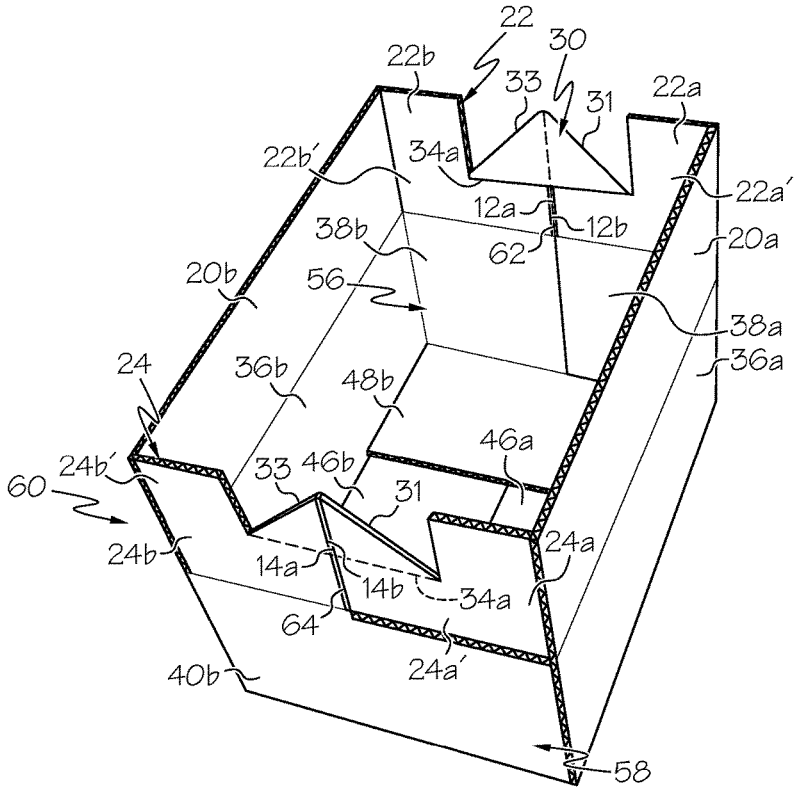
FIG. 5 is a perspective view illustrating the container formed with bottom flaps folded to form a container bottom.
Figure 6:
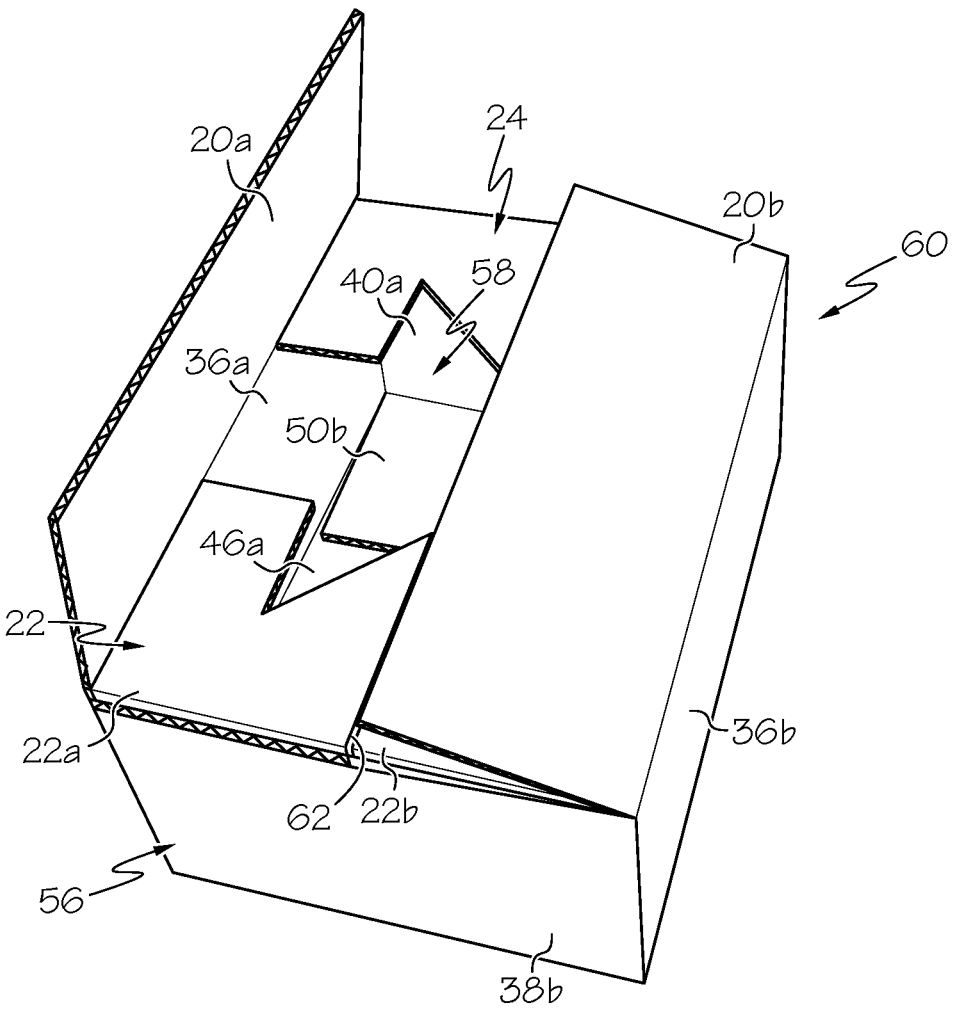
FIG. 6 is a perspective view illustrating partial closure of the top flaps of the container.

FIG. 4 illustrates a further pivoting movement of the inner end wall panels 38*a*, 40*a* and outer end wall panels 38*b*, 40*b* as they approach a final position perpendicular the side walls 36*a*, 36*b*, and shows the outer end wall panels 38*b*, 40*b* moving into overlapping relationship adjacent to the inner wall panels 38*a*, 40*a* to form the first and second end walls 56, 58 of a formed container 60, see FIGS. 5 and 6. The folded blank 10 comprising the end walls 56, 58 oriented perpendicular to the side walls 36*a*, 36*b* defines a rectangular tube having top flaps 20*a*, 20*b*, 22, 24 and bottom flaps 46*a*, 46*b*, 48*b*, 50*b* having a configuration corresponding to that of a regular slotted container, and can be formed without requiring use of tape, adhesive or similar attachment means between the end walls and side walls.

During the pivoting movement of the inner and outer end wall panels 38*a*, 40*a* and 38*b*, 40*b*, the outer longitudinal sides 12*a*, 12*b* of the top end flap 22 move adjacent to each other to define a flap slit 62 in the top end flap 22, and the outer longitudinal sides 14*a*, 14*b* of the top end flap 24 move adjacent to each other to define a flap slit 64 in the top end flap 24. It may be noted that the flap 22 of the formed container 60 comprises the two half sections 22*a*, 22*b*, wherein the half section 22*a* is hingedly connected to the inner end wall panel 38*a* and the half section 22*b* is hingedly connected to the outer end wall panel 38*b*. Similarly, the flap 24 of the formed container 60 comprises the two half sections 24*a*, 24*b*, wherein the half section 24*a* is hingedly connected to the inner end wall panel 40*a* and the half section 24*b* is hingedly connected to the outer end wall panel 40*b*. The bow-tie locks 30, 32 define connectors integrally formed as part of respective pairs of the half sections 22*a*, 22*b* and 24*a*, 24*b*. The bow-tie locks 30, 32 are formed with and extend between remaining parts 22*a*', 22*b*' and 24*a*', 24*b*' of the respective pairs of the half sections 22*a*, 22*b* and 24*a*, 24*b*. Each bow-tie lock 30, 32 defines a triangular section having a base 34*a* extending laterally across a respective flap slit 62, 64, and including sides 31, 33 corresponding to the locations of the score lines S1, S2 extending diagonally from opposing ends of the base 34*a* to a point at an end of a respective flap slit 62, 64.

As seen in FIGS. 5 and 6, the bottom end flaps 48*b*, 50*b* can be folded perpendicular to the end walls 56, 58. The bottom lateral flaps 46*a*, 48*b* can be folded over the bottom end flaps 48*b*, 50*b* perpendicular to the side walls 36*a*, 36*b*. The bottom lateral flaps 46*a*, 46*b* can be attached together, such as by taping, to form a container bottom. Closure of the container 60 is completed by folding the top end flaps 22, 24 to a position perpendicular to the end walls 56, 58, and the top lateral flaps 20*a*, 20*b* can then be folded over the top end flaps 22, 24, as illustrated by the partial closure of the top lateral flaps 20*a*, 20*b* in FIG. 6.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A blank for making a one-piece container comprising:

a central first section;

a pair of second sections connected to the first section along a respective first longitudinal score line, the second sections defining side walls and end walls of the container;

a pair of third sections, each third section connected to a second section along a respective second longitudinal score line, the third sections defining bottom flaps of the container;

the first section including a pair of top lateral flaps located on either side of a longitudinal slit that divides the blank in half, and a pair of top end flaps spanning across opposing longitudinal ends of the top lateral flaps; and each top end flap comprises a triangular section defining a bow-tie lock connecting two halves of the blank on either side of the longitudinal slit.

2. The blank as set forth in claim 1, wherein the longitudinal slit extends into the top end flaps, and including first lateral slits bisected by the longitudinal slit and defining a separation between the top lateral flaps and each top end flap.

3. The blank as forth in claim 2, wherein each bow-tie lock is defined by a pair of perforated score lines that diverge from an area at an outer longitudinal side of the corresponding top end flap.

4. The blank as set forth in claim 3, wherein the perforated score lines of each bow-tie lock have distal ends connected by a second lateral slit that is bisected by an end of the longitudinal slit.

5. The blank as set forth in claim 4, wherein each top end flap is divided into two half sections along a first portion by the longitudinal slit and along a remaining portion by a central score line extending longitudinally across the bow-tie lock, and the two half sections of each top end flap are pivotable relative to each other about the bow-tie lock during formation of the container to position the outer longitudinal sides of the two half sections adjacent to each other.

6. The blank as set forth in claim 1, wherein each of the second sections include a side wall and first and second end wall panels connected to opposing longitudinal ends of the side wall along respective lateral score lines.

7. The blank as set forth in claim 6, wherein first lateral slits span between the first longitudinal score lines, and the lateral score lines are collinear with respective ones of the first lateral slits.

8. The blank as set forth in claim 6, wherein a lateral edge of each of the end wall panels is connected to a lateral edge of one of the top end flaps at a respective first longitudinal score line.

9. The blank as set forth in claim 6, wherein each of the third sections include a bottom lateral flap connected to one of the side walls at a respective second longitudinal score line, and one of the third sections further includes first and second bottom end flaps connected to adjacent first and second end wall panels along one of the second longitudinal score lines.

10. A container including a pair of opposing side walls and a pair of opposing end walls, a top lateral flap hingedly connected to each side wall, a top end flap hingedly connected to each end wall, and bottom flaps hingedly connected to the side walls and the end walls, the container further comprising:

each top end flap comprising two half sections separated by a flap slit; and each top end flap further comprising a bow-tie lock integrally formed as part of the two half sections of the top end flap, the bow-tie lock spanning the flap slit and connecting the two half sections.

11. The container as set forth in claim 10, wherein each bow-tie lock defines a triangular section having a base extending laterally across the flap slit and sides extending diagonally from the base to a point at the flap slit.

12. The container as set forth in claim 10, wherein each end wall comprises an inner end wall panel hingedly connected to one of the side walls and an outer end wall panel hingedly connected to the other of the side walls and overlapping an adjacent inner end wall panel.

13. The container as set forth in claim 12, wherein one of the two half sections of each top end flap is hingedly connected to one of the inner end wall panels and the other of the two half sections is hingedly connected to one of the outer end wall panels.

14. A method of forming a container from a blank, the blank comprising a central first section; a pair of second sections connected to the first section along a respective first longitudinal score line, the second sections defining side walls and end walls of the container and comprising first and second end wall panels connected at lateral score lines to longitudinal ends of each of the side walls; a pair of third sections, each third section connected to a second section along a respective second longitudinal score line, the third sections defining bottom flaps of the container; the first section including a pair of top lateral flaps located on either side of a longitudinal slit that divides the blank in half, and a pair of top end flaps spanning across opposing longitudinal ends of the top lateral flaps; each top end flap including a triangular section defining a bow-tie lock connecting two halves of the blank on either side of the longitudinal slit, the method comprising:

folding the blank in half at the longitudinal slit line to position a first half of the blank adjacent to a second half of the blank; and folding the first and second end wall panels about the lateral score lines to orient the end wall panels perpendicular to the side walls, wherein the end walls of the container are each defined by a pair of the end wall panels positioned in overlapping relationship adjacent to each other.

15. The method as set forth in claim 14, wherein each top end flap comprises two half sections and a bow-tie lock integrally formed as part of the two half sections.

16. The method as set forth in claim 15, wherein the two half sections of each top end flap are pivotable relative to each other about the bow-tie lock during folding of the blank so as to position outer longitudinal sides of the two half sections adjacent to each other and define a flap slit separating the two half sections.

17. The method as set forth in claim 14, wherein the end wall panels defining each end wall comprise adjacent inner and outer end wall panels, and one of the two half sections of each top end flap is hingedly connected to one of the inner end wall panels and the other of the two half sections is hingedly connected to one of the outer end wall panels.

* * * * *